United States Patent [19]

Hardey et al.

[11] Patent Number: 4,690,198

[45] Date of Patent: Sep. 1, 1987

[54] INJECTOR FOR INJECTING MOLTEN MATERIAL INTO A DIE

[75] Inventors: Donald H. Hardey; Franklin D. Austin, both of Rockford, Ill.

[73] Assignee: Castech Enterprises, Inc., Rockford, Ill.

[21] Appl. No.: 780,810

[22] Filed: Sep. 27, 1985

[51] Int. Cl.[4] ..... B22D 17/04

[52] U.S. Cl. ..... 164/316; 164/303

[58] Field of Search ..... 164/303-305, 164/312-318; 425/564, 566

[56] References Cited

FOREIGN PATENT DOCUMENTS

| | | | |
|---|---|---|---|
| 1483620 | 7/1971 | Fed. Rep. of Germany | 164/316 |
| 2747342 | 4/1979 | Fed. Rep. of Germany | 164/312 |
| 55-136554 | 10/1980 | Japan | 164/316 |
| 55-156659 | 12/1980 | Japan | 164/318 |

*Primary Examiner*—Nicholas P. Godici
*Assistant Examiner*—Richard K. Seidel
*Attorney, Agent, or Firm*—Grace J. Fishel

[57] ABSTRACT

An injector of the piston type for a die casting machine is disclosed having means for ejecting molten material mixed with a minimal volume of air and means for compensating for thermal expansion such that the pressure applied between the nozzle of the injector and the gate of a die is substantially constant as the injector heats up.

9 Claims, 4 Drawing Figures

INJECTOR FOR INJECTING MOLTEN MATERIAL INTO A DIE

The present invention relates to an improved injector of the piston type.

One type of die casting machine includes as its principal parts a head for supporting die parts and holding them under pressure during a die casting operation and an injector for forcing molten material into the assembled die and maintaining it under pressure until solidification is sufficiently complete.

Injectors of the piston type force molten material through a nozzle into the gate of a die by means of a cylinder with a plunger submerged in a pot of molten material. On the downward stroke of the plunger, molten material is forced up a delivery tube to the nozzle which is held in the gate with a sufficient force that molten material is injected into the die without squirting out.

In the past, injectors of the piston type have either been rocked or reciprocated into communication with the die. If the injector is reciprocated with a cylinder or the like, it is now recognized that unless some provision is made for thermal expansion, the force applied to the nozzle will increase as the injector heats up causing damage to the nozzle and/or the die.

After a shot of molten material has been fired into the die, the molten material which is not ejected through the nozzle falls back down the delivery tube on the upward stroke of the plunger. When the cycle begins again, air is mixed with the molten material as it starts up the delivery tube giving rise to a casting having voids or a non-uniform density.

In view of the above, it is an object of the present invention to provide an improved ejector of the piston type. More particularly, the present invention provides a mechanism for ejecting molten material mixed with a minimal volume of air and for compensating for thermal expansion such that the pressure applied between the nozzle and the gate is substantially constant as the injector heats up. Other objects and features will be in part apparent and in part pointed out hereinafter. The invention accordingly comprises the structures hereinafter described, the scope of the invention being indicated by the subjoined claims.

In the drawings in which one of various possible embodiments of the invention is illustrated, corresponding reference numerals refer to corresponding parts, and in which.

Figure 1:
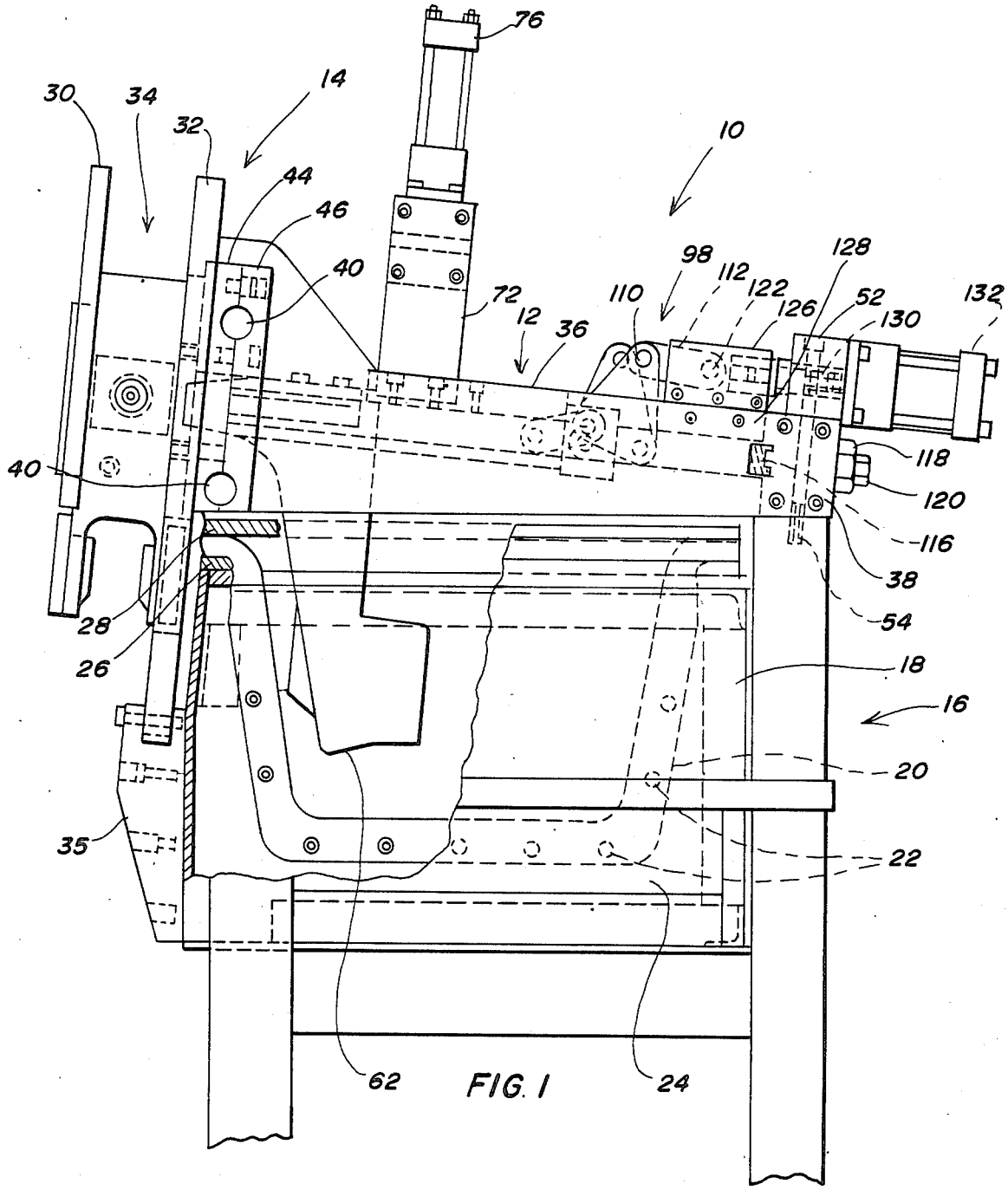
FIG. 1 is a side elevational view of an injector in accordance with the present invention mounted on a supporting structure over a pot of molten material.

Referring to the drawings more particularly by reference character, reference numeral 10 refers to a die casting machine having an injector 12 and a head 14 mounted on a supporting structure or frame 16. As shown in FIG. 1, frame 16 includes four upstanding legs joined by rails upon which a pot enclosure 18 is seated. A melting pot 20 with a generally flat bottom connected to upwardly and outwardly extending walls with an outwardly extending flange on its upper edges is hung by its flange in pot enclosure 18. Electrical heating elements 22 are embedded in the sidewalls of melting pot 20 for more efficient heat transfer to the material being melted in the pot. The backside of melting pot 20 is insulated from pot enclosure 18 with a loose fill of insulation 24 and with a gasket 26 under its supporting flange. In addition to insulating the pot, pot enclosure 18 also serves to retain the molten material in the event that the pot should fail. Thermal insulation of the pot is completed with a cover 28 having an aperture through which the lower end of injector 12 extends as more particularly described below and an aperture through which ingots may be fed to replenish the amount of material in the melting pot.

Head 14 includes a pair of spaced apart, parallel plates 30 and 32 between which are mounted die parts 34 with means for reciprocating the die parts into an assembled die and maintaining them under pressure while a part is being cast. Head 14 is securely attached by plate 32 at about a 10 degree angle to vertical through bracket 35 at one side of frame 16 and above melting pot 20. Rear plate 32 is provided with an aperture through which the closed die is accessed by injector 12.

Figure 2:
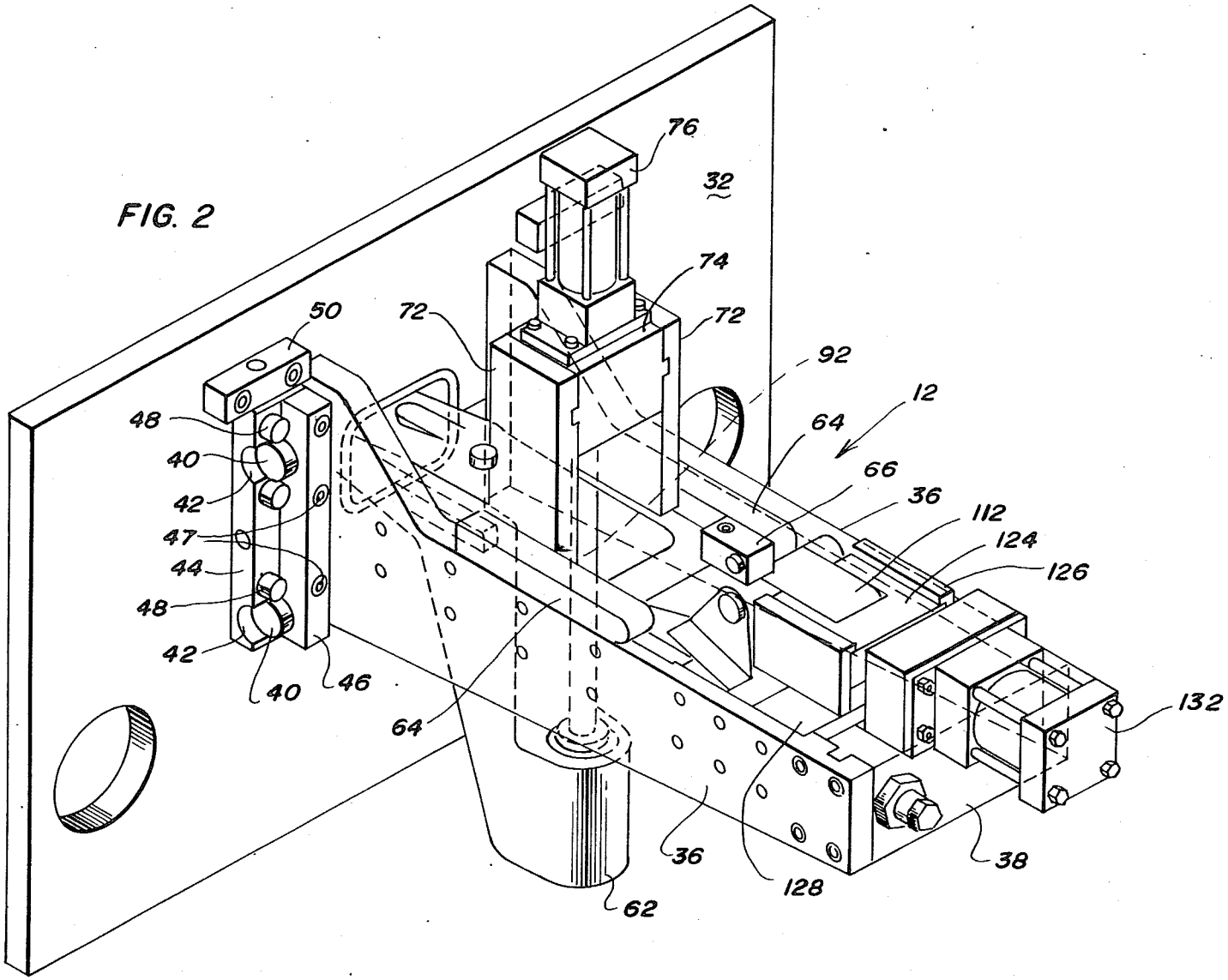
FIG. 2 is a perspective view of the injector.

Injector 12 includes a pair of parallel side mounts 36 joined at one end by a cylinder mounting block 38 and widened at the other end for attachment to rear plate 32 as best seen in FIG. 2. Provision is made for adjusting injector 12 horizontally and vertically such that the nozzle of the injector may be aligned with the die, the parting line and sprue of which may not be on centerline of the machine. More particularly, the outboard edge of the widened end of each side mount 36 is attached to a pair of trunion pins 40 which are received in trunion mounts 42 in vertical mounting blocks 44. A trunion cap 46 locks trunion pins 40 in trunion mounts 42 and bolts 47 attach trunion cap 46 to vertical mounting blocks 44. Bolts 48 attach vertical mounting blocks 44 to rear plate 32 and are received in elongated slots in said vertical mounting blocks such that the widened end of side mounts 36 is adjustable vertically on bolts 48 by screw adjustment through an adjusting block 50 which is positioned above vertical mounting blocks 44 and attached to rear plate 32 while horizontal adjustment is accomplished by sliding trunion pins 40 in trunion mounts 42. Horizontal adjustment of injector 12 at cylinder mounting block 38 is accomplished by a downwardly extending T-nut 52 which rides in a T-slot 54 provided in a top surface of frame 16.

Figure 3:
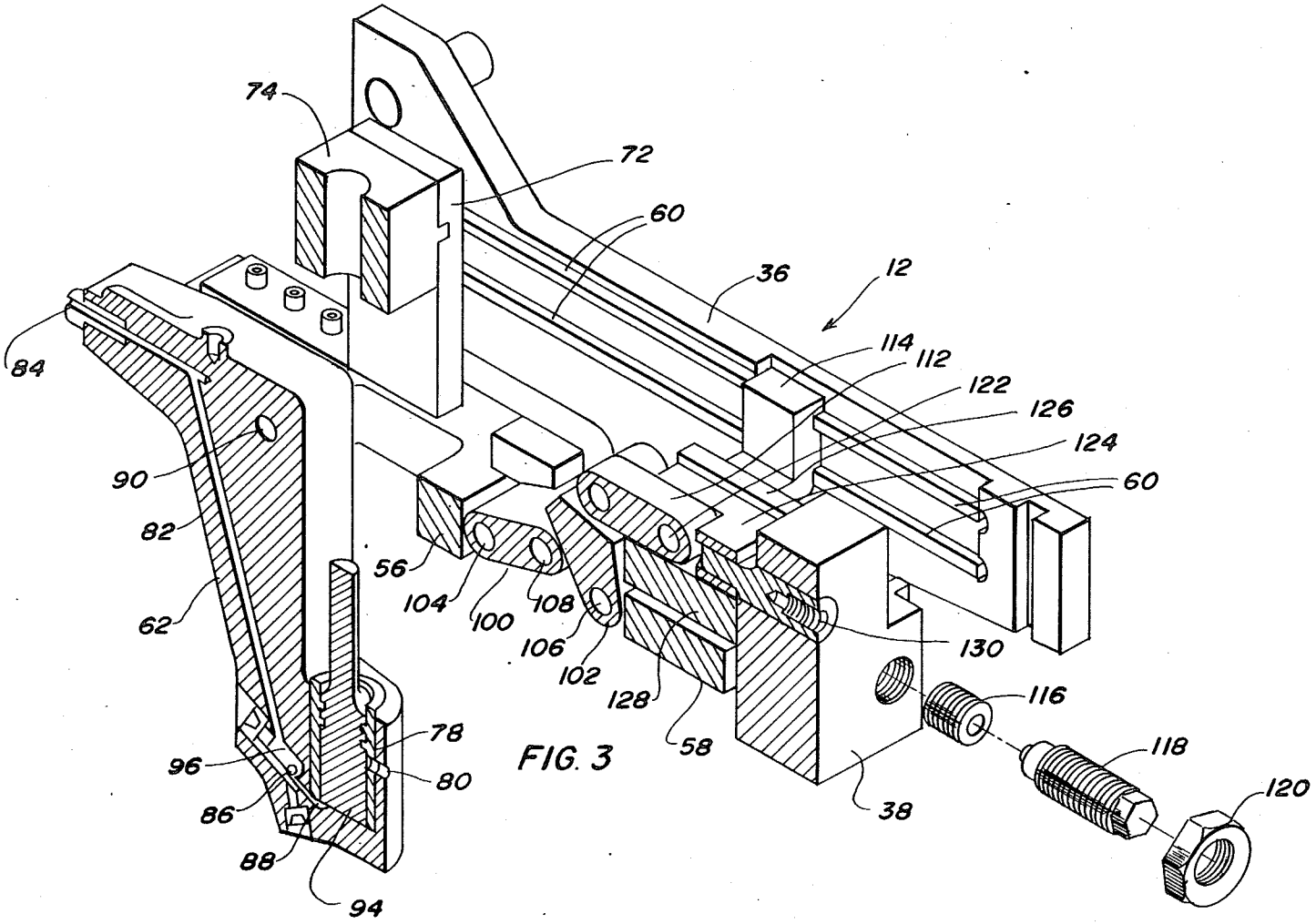
FIG. 3 is taken along the longitudinal centerline of the injector shown in FIG. 2; and, FIG. 4 is an exploded view showing portions of the injector.
Figure 4:
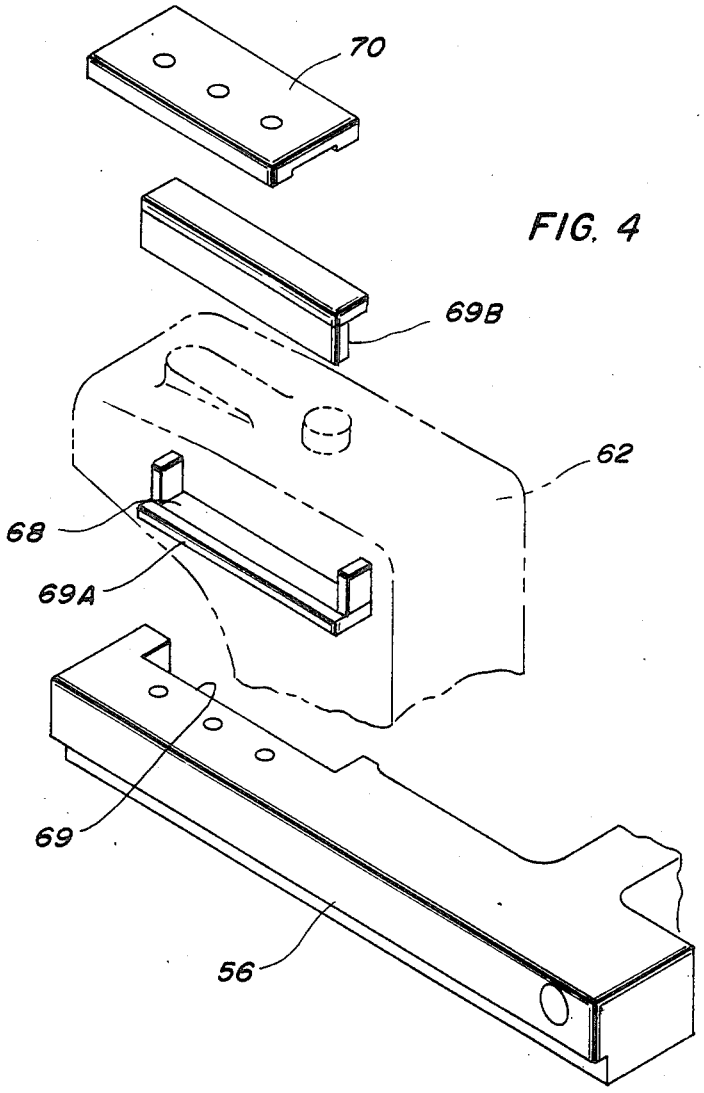

As best seen in FIG. 3, an H-shaped injector slide 56 and a U-shaped toggle arm slide 58 are received between side mounts 36 on a pair of parallel rails 60 running the length thereof. A gooseneck 62 depends between the arms of injector slide 56 facing rear plate 32 and a pair of horizontal cylinder supports 64 are pivoted in pivot blocks 66 on its legs. As illustrated in FIG. 4, gooseneck 62 includes a pair of support lugs 68 by which it is suspended between the arms of injector slide 56 in a pocket 69 insulated with insulation 69A and 69B. An injector clamp 70 is further provided for locking the gooseneck in the insulated pocket. With reference to FIG. 3, a pair of vertical risers 72 are attached adjacent the free end and perpendicular to cylinder supports 64 and are joined at their upper end by a cylinder mounting block 74 on which is mounted a shot cylinder 76. Cylinder 76 and its supporting structure can be pivoted on pivot blocks 66 out of the way when it is necessary to access the gooseneck for removal from injector slide 56.

With continuing reference to FIG. 3, the lower end of gooseneck 62 extends downwardly into melting pot 20 and is bored with a cylinder well 78. An inlet 80 communicates cylinder well 78 with the molten material in melting pot 20 and a delivery tube 82 connects the cylinder well at the lower end of the gooseneck with a nozzle 84 at its upper end. A check valve 86 is provided in the delivery tube at the outlet 88 of cylinder well 78 and below the level of the molten material in melting pot 20. Electrical heaters 90 are provided in the sidewalls of gooseneck 62 to maintain the temperature of the molten material in the delivery tube. Shot cylinder 76 is connected by a rod extension 92 to a plunger 94 which is reciprocated in cylinder well 78 by the piston of the shot cylinder. On the upward stroke of the piston, it is important that check valve 86 be easily reseated by the weight of the molten material in delivery tube 82 and to this end check valve 86 is confined in a pocket 96 in a portion of delivery tube 82 inclined towards outlet 88 in which the check valve is seated.

A toggle linkage 98 connects injector slide 56 to toggle arm slide 58. Toggle linkage 98 includes a first and second hinged member 100 and 102, illustrated as a toggle link and a toggle arm, respectively. The first hinged member 100 is pivoted at 104 between the legs of injector slide 56 and second hinged member 102 is pivoted at 106 between the arms of U-shaped toggle arm slide 58. As shown in FIG. 3, one end of toggle link 100 is articulated on pin 108 at the midpoint of toggle arm 102 and the other end of toggle arm 102 is connected at pin 110 to a second toggle link 112.

The motion of toggle arm slide 58 is confined on rails 60 between a front stop 114 and a rear stop provided by cylinder mounting block 38. Resilient biasing means, shown as a pair of load springs 116 provide means for compensating for thermal expansion as more particularly described hereinafter and are inserted between toggle arm slide 58 and cylinder mounting block 38. As shown, resilient biasing means 116 are adjustably biased with threaded member 118 and when adjusted are locked with locking nut 120.

Second toggle link 112 is connected at pin 122 to a slide 124 which moves in a slide retainer 126 on a slide support 128 which is attached to side mounts 36 above toggle arm slide 58. The end of slide 124 opposite its point of attachment to second toggle link 112 is connected by a rod extension 130 to the piston of a toggle cylinder 132 which is mounted on cylinder mounting block 38.

Before the machine is operated, nozzle 84 is aligned with the sprue of a closed die. This is accomplished by means of adjustments made to side mounts 36 at mounting blocks 44 and T-nut 52. Once the nozzle is aligned with the die, toggle linkage 98 is adjusted so that the nozzle is held in the gate with a sufficient force that molten material is injected into the die and does not squirt out. To this end, the piston on cylinder 132 is extended articulating toggle linkage 98 until it is fully linearly extended. Load springs 116 are then set with members 118 to provide the necessary force on nozzle 84 which force is transferred from load springs 116 to nozzle 84 through toggle linkage 98.

At the start of a die casting cycle and as dies 34 are closed, a proximity switch signals cylinder 132 to extend its piston causing toggle linkage 98 to move injector slide 56 on rails 60 until nozzle 84 is pressed into the gate. As load springs 116 are compressed, another proximity switch signals shot cylinder 76 to extend its piston reciprocating plunger 94 in cylinder well 78. On the continued downward stroke of plunger 94, inlet 80 is blocked and check valve 86 is unseated from outlet 88. Molten material is forced by plunger 94 up delivery tube 82 out of nozzle 84 into the closed die.

Injector 12 then waits a predetermined time for the part being cast to become sufficiently solidified and then signals shot cylinder 76 to retract its piston. On the upward stroke of plunger 94 in cylinder well 78, check valve 86 is drawn out of pocket 96 which is inclined in the direction of outlet 88 and quickly reseated by the weight of the molten material in delivery tube 82 while electrical heaters 90 keep the molten material in gooseneck 62 heated ready for the next cycle. Since delivery tube 82 is filled with molten material at the beginning of each shot, the molten material provided to the die is mixed with a minimal volume of air providing superior castings of uniform density and without voids.

Cylinder 132 is then signaled to retract its piston unlocking toggle linkage 98 causing toggle arm slide 58 to move on rails 60 under pressure of load springs 116 until halted by stop 114. As toggle arm slide 58 moves, toggle linkage 98 shortens and injector slide 56 is pulled on rails 60 towards toggle arm slide 58. This motion triggers another proximity switch opening die 34 and ejecting the part thus completing the cycle.

During a die casting operation, any thermal expansion extending the length of injector slide 56, toggle linkage 98 and toggle arm slide 58 is compensated for by load springs 116 which provide means for compensating for thermal expansion such that the force applied to the nozzle and the gate is substantially constant as the injector heats up.

In view of the above, it will be seen that the several objects of the invention are achieved and other advantageous results attained. As various changes could be made in the above structures without departing from the scope of the invention, it is understood that all matters contained in the above description shall be interpreted as illustrative and not in a limiting sense.

What is claimed is:

1. In an injector of the piston type for a die casting machine including a gooseneck with a cylinder well adjacent its lower end, said cylinder well connected at its outlet by a delivery tube to a nozzle adjacent the upper end of the gooseneck for injecting molten material into the gate of a die, an inlet communicating the cylinder well with molten material in which the lower end of the gooseneck is dipped and a plunger which is reciprocated in the cylinder well, the improvement wherein the gooseneck is mounted on a slide between a pair of side mounts joined at one end by a block forming a rigid support and a toggle linkage against which the slide is held under compressive force by the toggle linkage and wherein a means for compensating for thermal expansion which maintains a substantially constant compressive force on the nozzle in the gate of the die is provided between the toggle linkage and the block.

2. The injector of claim 1 where a check valve is provided in the outlet of the cylinder well.

3. The injector of claim 2 wherein the check valve is located below the inlet.

4. The injector of claim 3 wherein the check valve is confined in a pocket inclined towards the outlet and formed in a portion of the delivery tube.

5. The injector of claim 3 wherein a heater is provided in the gooseneck to maintain material in the delivery tube in a molten condition.

6. The injector of claim 1 wherein the means for compensating for thermal expansion are resilient biasing means.

7. The injector of claim 6 wherein the resilient biasing means may be adjustably biased whereby the force with which the nozzle is held in the gate may be selected.

8. The injector of claim 1 wherein a cylinder for reciprocating the plunger is mounted on the slide on a supporting structure positioned above the gooseneck.

9. The injector of claim 8 wherein the supporting structure is mounted to the slide on pivots for movement away from the gooseneck so that the gooseneck may be accessed on the slide for removal.

* * * * *